US011238768B2

(12) United States Patent
Mi et al.

(10) Patent No.: US 11,238,768 B2
(45) Date of Patent: Feb. 1, 2022

(54) PIXEL CIRCUIT AND DRIVING METHOD THEREOF, DISPLAY SUBSTRATE, AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Lei Mi, Beijing (CN); Yanna Xue, Beijing (CN); Zhiying Bao, Beijing (CN); Yong Zhang, Beijing (CN); Lu Bai, Beijing (CN); Gang Hua, Beijing (CN); Jingpeng Wang, Beijing (CN); Haobo Fang, Beijing (CN); Lingxiang Yuan, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 556 days.

(21) Appl. No.: 16/301,646

(22) PCT Filed: Feb. 6, 2018

(86) PCT No.: PCT/CN2018/075435
§ 371 (c)(1),
(2) Date: Nov. 14, 2018

(87) PCT Pub. No.: WO2019/019605
PCT Pub. Date: Jan. 31, 2019

(65) Prior Publication Data

US 2021/0233448 A1 Jul. 29, 2021

(30) Foreign Application Priority Data

Jul. 26, 2017 (CN) ..... 201710618939.8

(51) Int. Cl.
*G09G 3/20* (2006.01)

(52) U.S. Cl.
CPC ..... *G09G 3/20* (2013.01); *G09G 2300/0426* (2013.01); *G09G 2310/0275* (2013.01)

(58) Field of Classification Search
CPC ..... G09G 3/20; G09G 2310/0275; G09G 2300/0426
See application file for complete search history.

(56) References Cited

U.S. PATENT DOCUMENTS 5,517,150 A * 5/1996 Okumura ..... H01L 27/12 257/E27.111
2002/0167477 A1* 11/2002 Tsutsui ..... G09G 3/3648 345/89

(Continued)

FOREIGN PATENT DOCUMENTS

CN 101614919 A 12/2009
CN 102169668 A 8/2011

(Continued)

OTHER PUBLICATIONS

International Search Report of PCT/CN2018/075435 in Chinese, dated May 8, 2018, with English translation.

(Continued)

*Primary Examiner* — Carolyn R Edwards
(74) *Attorney, Agent, or Firm* — Collard & Roe, P.C.

(57) ABSTRACT

The embodiments of the present disclosure disclose a pixel circuit and a driving method thereof, a display substrate, and a display device, the present disclosure belongs to the field of displaying. The pixel circuit includes a gate line, a data line, a first charging sub-circuit, a second charging sub-circuit and a display sub-circuit; the first charging sub-circuit is configured to be controllable to output a data signal from the data line to a charging node and to store the data signal from the data line; and the second charging sub-circuit (Continued)

is respectively connected to the charging node, the gate line and the display sub-circuit, and is configured to be controllable to output a data signal from the charging node to the display sub-circuit.

11 Claims, 10 Drawing Sheets

(56) References Cited

U.S. PATENT DOCUMENTS

2008/0122804 A1* 5/2008 Kinoshita ..... G06F 3/0412 345/175
2011/0205481 A1* 8/2011 Aruga ..... G09G 3/3648 349/151
2012/0229443 A1* 9/2012 Liu ..... G09G 3/3614 345/212
2012/0320004 A1* 12/2012 Kitakado ..... G09G 3/3648 345/204
2016/0086978 A1* 3/2016 French ..... H01L 27/1218 257/72

FOREIGN PATENT DOCUMENTS

CN 102800288 A 11/2012
CN 106157903 A 11/2016
CN 106842748 A 6/2017
CN 107221300 A 9/2017
WO 2011083598 A1 7/2011

OTHER PUBLICATIONS

Notice of Transmittal of the International Search Report of PCT/CN2018/075435 in Chinese, dated May 8, 2018.
Written Opinion of the International Searching Authority of PCT/CN2018/075435 in Chinese, dated May 8, 2018 with English translation.

* cited by examiner

PIXEL CIRCUIT AND DRIVING METHOD THEREOF, DISPLAY SUBSTRATE, AND DISPLAY DEVICE

CROSS REFERENCE TO RELATED APPLICATIONS

This application is the National Stage of PCT/CN2018/075435 filed on Feb. 6, 2018, which claims priority under 35 U.S.C. § 119 of Chinese Application No. 201710618939.8 filed on Jul. 26, 2017, the disclosure of which is incorporated by reference.

TECHNICAL FIELD

The present disclosure relates to a pixel circuit and a driving method thereof, a display substrate, and a display device.

BACKGROUND

A liquid crystal display includes a plurality of pixel units enclosed by a plurality of data lines and a plurality of gate lines that are intersected, the plurality of pixel units are arranged in an array, wherein each pixel unit includes a pixel circuit, and the pixel circuit specifically comprises a thin film transistor (abbreviation: TFT) and a liquid crystal capacitor, wherein the liquid crystal capacitor is formed by the pixel electrode in the pixel unit and the common electrode. The TFT is used to charge the liquid crystal capacitor, and the liquid crystal capacitor is used to control deflection of liquid crystal molecules, thereby realizing image display.

In the related art, the liquid crystal capacitor in each pixel circuit is charged by one TFT, and gates of TFTs in a plurality of pixel circuits in the same row are connected to the same one gate line, and this gate line is used to control on and off of the TFTs, sources of TFTs in the plurality of pixel circuits are connected to different data lines, and the drain of each TFT is connected to the pixel electrode. When the TFT is turned on under control of the gate line, the data signal on the data line can be written to the pixel electrode, thereby charging the liquid crystal capacitor.

However, after the TFT is turned off, the drain of the TFT may probably output a leakage current to the data line, causing the voltage of the pixel electrode to decrease, affecting deflection of liquid crystal molecules, thereby affecting image display effect of the display.

SUMMARY

In order to solve the technical problem that the drain of the TFT may probably output a leakage current to the data line, causing the voltage of the pixel electrode to decrease, affecting deflection of liquid crystal molecules, thereby affecting image display effect of the display as existing in the related art, the embodiments of the present disclosure provide a pixel circuit and a driving method thereof, a display substrate, and a display device. The technical solutions are as follows.

In a first aspect, there is provided a pixel circuit, the pixel circuit comprising:

a gate line, a data line, a first charging sub-circuit, a second charging sub-circuit and a display sub-circuit;

the first charging sub-circuit is configured to be controllable to output a data signal from the data line to a charging node and to store the data signal from the data line; and the second charging sub-circuit is respectively connected to the charging node, the gate line and the display sub-circuit, and is configured to be controllable to output a data signal from the charging node to the display sub-circuit.

Optionally, the first charging sub-circuit comprises a first transistor and a storage capacitor;

a gate of the first transistor is connected to the gate line; or, the pixel circuit further comprises a control line, the gate of the first transistor is connected to the control line;

a first electrode of the first transistor is connected to the data line, and a second electrode of the first transistor is connected to the charging node;

one terminal of the storage capacitor is connected to the charging node, and the other terminal of the storage capacitor is connected to a common electrode.

Optionally, the first charging sub-circuit comprises at least two charging sub-sub-circuits connected in series, each charging sub-sub-circuit comprises a first transistor and a storage capacitor;

a gate of the first transistor is connected to the gate line; or, the pixel circuit further comprises a control line, the gate of the first transistor is connected to the control line;

a second electrode of the first transistor is connected to one terminal of the storage capacitor, and the other terminal of the storage capacitor is connected to a common electrode;

among the plurality of charging sub-sub-circuits connected in series, a first electrode of the first transistor in a first charging sub-sub-circuit is connected to the data line, and a second electrode of the first transistor in a second charging sub-sub-circuit is connected to the charging node;

the first charging sub-sub-circuit and the second charging sub-sub-circuit are charging sub-sub-circuits at two ends of the at least two charging sub-sub-circuits connected in series.

Optionally, the second charging sub-circuit comprises a second transistor;

a gate of the second transistor is connected to the gate line, a first electrode of the second transistor is connected to the charging node, and a second electrode of the second transistor is connected to the display sub-circuit.

Optionally, the gate of the first transistor is connected to the control line, and the control line and the gate line are electrically connected to each other.

Optionally, the pixel circuit comprises a plurality of control lines, the gate of the first transistor in each charging sub-sub-circuit is respectively connected to a different control line.

Optionally, the display sub-circuit comprises a liquid crystal capacitor, and a capacitance value of the storage capacitor in the pixel circuit is greater than a capacitance value of the liquid crystal capacitor.

In a second aspect, there is provided a driving method of a pixel circuit, wherein the pixel circuit comprises a gate line, a data line, a first charging sub-circuit, a second charging sub-circuit and a display sub-circuit, the second charging sub-circuit is respectively connected to the charging node, the gate line and the display sub-circuit, the method comprises:

controlling the first charging sub-circuit to output a data signal from the data line to the charging node and to store the data signal from the data line; and providing, by the gate line, a gate driving signal of a first voltage level, and outputting, by the second charging sub-circuit, a data signal from the charging node to the display sub-circuit.

Optionally, the display sub-circuit comprises a liquid crystal capacitor; the pixel circuit further comprises a control line; the first charging sub-circuit comprises a first transistor and a storage capacitor, a gate of the first transistor is connected to the control line; the second charging sub-circuit comprises a second transistor, a gate of the second transistor is connected to the gate line; a second electrode of the first transistor is connected to a first electrode of the second transistor;

controlling the first charging sub-circuit to output a data signal from the data line to the charging node and to store the data signal from the data line comprises:

providing, by the control line, a gate driving signal of a first voltage level, turning on the first transistor, and charging, by the data line, the storage capacitor through the first transistor;

providing, by the gate line, a gate driving signal of a first voltage level, and outputting, by the second charging sub-circuit, a data signal from the charging node to the display sub-circuit comprises:

providing, by the gate line, a gate driving signal of a first voltage level, turning on the second transistor, and charging, by the storage capacitor, the liquid crystal capacitor through the second transistor.

Optionally, the display sub-circuit comprises a liquid crystal capacitor, the first charging sub-circuit comprises a first transistor and a storage capacitor, a gate of the first transistor is connected to the gate line; the second charging sub-circuit comprises a second transistor, a gate of the second transistor is connected to the gate line; a second electrode of the first transistor is connected to a first electrode of the second transistor;

when the gate line provides a gate driving signal of a first voltage level, the first transistor and the second transistor are turned on, and the data line charges the liquid crystal capacitor through the first transistor and the second transistor.

Optionally, the method further comprises:

providing, by the control line, a gate driving signal of a second voltage level, and disconnecting the charging node from the data line; and providing, by the gate line, a gate driving signal of a second voltage level, disconnecting the charging node from the liquid crystal capacitor.

In a third aspect, there is provided a display substrate, comprising a plurality of gate lines, a plurality of data lines and a plurality of pixel units enclosed by said gate lines and said data lines that are intersected, the plurality of pixel units being arranged in an array, wherein each pixel unit includes a pixel circuit, and the pixel circuit is the pixel circuit according to any one of the first aspect.

Optionally, the display substrate further comprises a plurality of control lines, the first charging sub-circuit in the pixel circuit is connected to the control line, and is located in two pixel units that are in the same column and adjacent, a gate line connected to the second charging sub-circuit in a first pixel unit and a control line connected to the first charging sub-circuit in a second pixel unit are electrically connected to each other, wherein the first pixel unit and the second pixel unit are arranged in accordance with a direction in which the plurality of pixel units are scanned by the plurality of gate lines.

In a fourth aspect, there is provided a display device, comprising the display substrate according to any one of the third aspect.

The beneficial effects brought by the technical solutions provided by the embodiments of the present disclosure are:

In the pixel circuit and the driving method thereof, the display substrate, and the display device provided by the embodiments of the present disclosure, the first charging sub-circuit and the second charging sub-circuit are spaced between the data line and the display sub-circuit in the pixel circuit, the first charging sub-circuit outputs a data signal to the charging node, after the second charging sub-circuit outputs the data signal from the charging node to the display sub-circuit, the first charging sub-circuit can store the data signal, so that the charging node can be kept at a high voltage, and a voltage difference between two terminals of the second charging sub-circuit is relatively small, this relatively small voltage difference causes a leakage current outputted to the data line to decrease, thus effectively reducing the influence caused by the leakage current on deflection of liquid crystal molecules, and ensuring the image display effect of the display.

BRIEF DESCRIPTION OF THE DRAWINGS

In order to more clearly explain the technical solutions in the embodiments of the present disclosure, drawings necessary for describing the embodiments will be briefly introduced below, obviously, the following described drawings are merely some embodiments of the present disclosure, for those of ordinary skill in the art, it is possible to obtain other drawings based on these drawings.

FIG. 1-2 is a schematic diagram of structure of a pixel circuit according to an embodiment of the present disclosure;

FIG. 1-3 is a schematic diagram of structure of another pixel circuit according to an embodiment of the present disclosure;

FIG. 2-1 is a simulation diagram of a voltage holding situation of the voltage at the second electrode of the first transistor within one frame of time after the pixel circuit shown in FIG. 1-2 charges the liquid crystal capacitor;

FIG. 2-2 is a simulation diagram of a voltage holding situation of the voltage at the second electrode of the second transistor within one frame of time after the pixel circuit shown in FIG. 1-2 charges the liquid crystal capacitor;

FIG. 3-1 is a schematic diagram of structure of still another pixel circuit according to an embodiment of the present disclosure;

FIG. 3-2 is a schematic diagram of structure of still yet another pixel circuit according to an embodiment of the present disclosure;

FIG. 6-1 is a schematic diagram showing waveform of a gate driving signal loaded on a control line connected to the gate of the first transistor and a gate line connected to the gate of the second transistor according to an embodiment of the present disclosure;

FIG. 6-2 is a schematic diagram showing another waveform of a gate driving signal loaded on a control line connected to the gate of the first transistor and a gate line connected to the gate of the second transistor according to an embodiment of the present disclosure;

FIG. 6-3 is a schematic diagram showing another waveform of a gate driving signal loaded on a control line connected to the gate of the first transistor and a gate line connected to the gate of the second transistor according to an embodiment of the present disclosure;

FIG. 6-4 is a schematic diagram showing a voltage waveform of the second electrode of the first transistor and a voltage waveform of the second electrode of the second transistor during the charging process according to an embodiment of the present disclosure;

FIG. 8-1 is a schematic diagram of connection between a plurality of gate lines, a plurality of control lines and a plurality of gate driving signal output terminals on a display substrate according to an embodiment of the present disclosure;

FIG. 8-2 is schematic diagram of waveform of the signal outputted by the respective gate driving signal output terminal when a plurality of gate lines and a plurality of control lines on a display substrate are connected to a plurality of gate driving signal output terminals according to an embodiment of the present disclosure; and FIG. 8-3 is a schematic diagram of waveform of the gate driving signal loaded on the respective gate line and the respective control line in the display substrate when a plurality of gate lines and a plurality of control lines on a display substrate are connected to a plurality of gate driving signal output terminals according to an embodiment of the present disclosure.

DETAILED DESCRIPTION OF THE EMBODIMENTS

Figure 1:
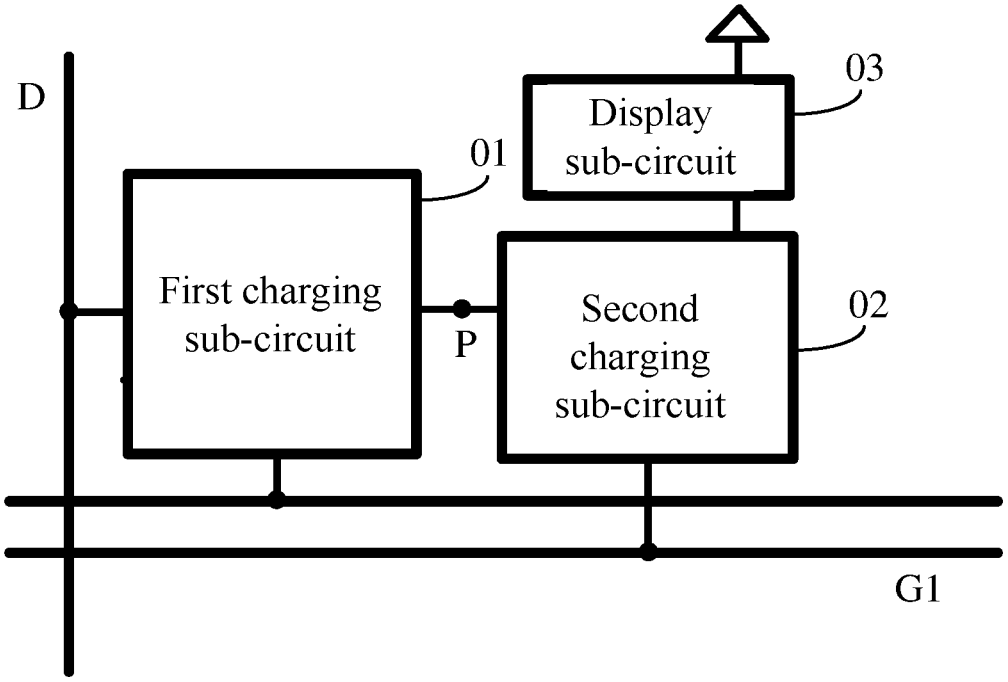
FIG. 1-1 is a block diagram of structure of a pixel circuit according to an embodiment of the present disclosure.

For the objectives, the technical solutions, and the advantages of the present disclosure to be more clear, implementations of the present disclosure will be described in further detail in combination with the drawings.

The transistors adopted in all the embodiments of the present disclosure may be thin film transistors, field effect transistors or other devices having the same property, and the transistors adopted in the embodiments of the present disclosure are mainly switching transistors according to their roles in the circuit. Since the source and the drain of the switching transistors adopted here are symmetrical, the source and the drain thereof are interchangeable. In the embodiments of the present disclosure, the source is referred to as the first electrode, and the drain is referred to as the second electrode. According to states in the drawings, it is prescribed that a middle terminal of the transistor is the gate, a signal input terminal is the source, and a signal output terminal is the drain. In addition, the switching transistor adopted in the embodiments of the present disclosure may be an N-type switching transistor, wherein the N-type switching transistor is turned on when the gate is at a high potential and is turned off when the gate is at a low potential. Moreover, a plurality of signals in various embodiments of the present disclosure correspondingly have a first voltage level and a second voltage level. The first voltage level and the second voltage level only represent that the potential of the signal has two state quantities, not that the first voltage level or the second voltage level in the full text has a specific value.

In the related art, the display product such as the smart wearable product adopts an operation mode of low power consumption: the display panel of the display product adopts a refresh rate of 1 Hz (that is, a time length of displaying one frame of image is 1 second), besides, the black and white display panel adopts 1-bit driving to achieve black and white displaying on the display panel, and the color display panel adopts 2-bit driving to achieve 64-color displaying on the display panel. When this operation mode is compared with the display panel having the refresh frequency of 60 Hz, voltage hold-up time of the pixel electrode increases by 60 times, its risk of electric leakage also increases accordingly. As for the display panel whose partial structure is made of amorphous silicon (abbreviation: a-Si), since the pixel electrode may probably output a leakage current to the data line after the transistor is turned off, the voltage of the pixel electrode is reduced, thus it is difficult for the voltage of the pixel electrode to be kept at a high potential for a relatively long time (e.g., 1 second), so that capacitance of the liquid crystal capacitor is reduced, thereby affecting deflection of liquid crystal molecules in the display panel, resulting in that image display effect of the display product is affected.

In view of the above problem, an embodiment of the present disclosure provides a pixel circuit, FIG. 1-1 is a block diagram of structure of the pixel circuit, as shown in FIG. 1-1, the pixel circuit may comprise:

a gate line G1, a data line D, a first charging sub-circuit 01, a second charging sub-circuit 02 and a display sub-circuit 03;

the first charging sub-circuit 01 is configured to be controllable to output a data signal from the data line D to a charging node P and to store the data signal from the data line D; and the second charging sub-circuit 02 is respectively connected to the charging node P, the gate line G1 and the display sub-circuit 03, and is configured to be controllable to output a data signal from the charging node P to the display sub-circuit 03.

In summary, in the pixel circuit provided by the embodiment of the present disclosure, the first charging sub-circuit and the second charging sub-circuit are spaced between the display sub-circuit and the data line, after the first charging sub-circuit outputs a data signal to the charging node and the second charging sub-circuit outputs the data signal from the charging node to the display sub-circuit, the first charging sub-circuit can store the data signal, so that the charging node can be kept at a high voltage, and a voltage difference between two terminals of the second charging sub-circuit is relatively small, this relatively small voltage difference causes a leakage current outputted to the data line to decrease, thus effectively reducing the influence caused by the leakage current on deflection of liquid crystal molecules, and ensuring the image display effect of the display.

It should be noted that, the display sub-circuit 03 may comprise a liquid crystal capacitor Clc, outputting the data signal from the charging node P to the display sub-circuit 03 is a process of charging the liquid crystal capacitor Clc. And since the liquid crystal capacitor Clc is formed by the pixel electrode in the pixel unit and the common electrode, the process of charging the liquid crystal capacitor Clc is actually a process of writing an electric signal to the pixel electrode.

Further, according to different application scenarios, structure of the first charging sub-circuit 01 may be implemented in multiple ways. The embodiments of the present disclosure are described with the following two implementable modes as an example.

Figures 1, 2:
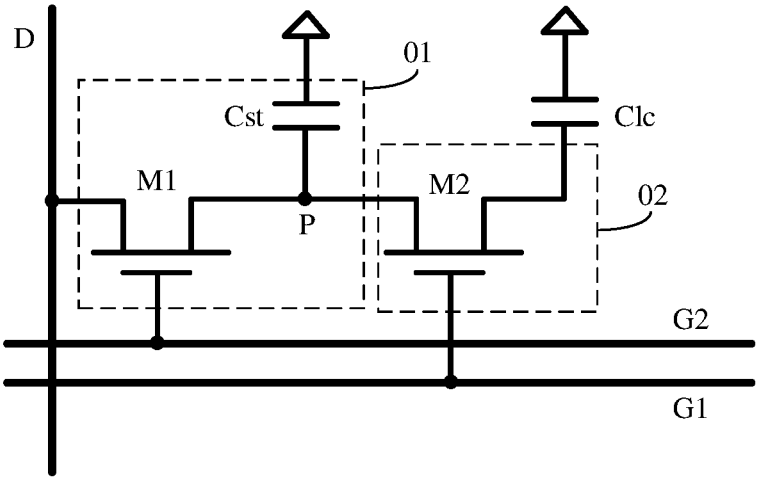

In a first implementable mode, as shown in FIG. 1-2, the first charging sub-circuit 01 may comprise a first transistor M1 and a storage capacitor Cst.

A gate of the first transistor M1 may be connected to the gate line G1 (this connection manner is not shown in FIG. 1-2).

Or, the pixel circuit may further comprise a control line G2, the gate of the first transistor M1 is connected to the control line G2.

A first electrode of the first transistor M1 is connected to the data line D, and a second electrode of the first transistor M1 is connected to the charging node P; one terminal of the storage capacitor Cst is connected to the charging node P, and the other terminal of the storage capacitor Cst is connected to a common electrode.

Figures 1, 2, 3:
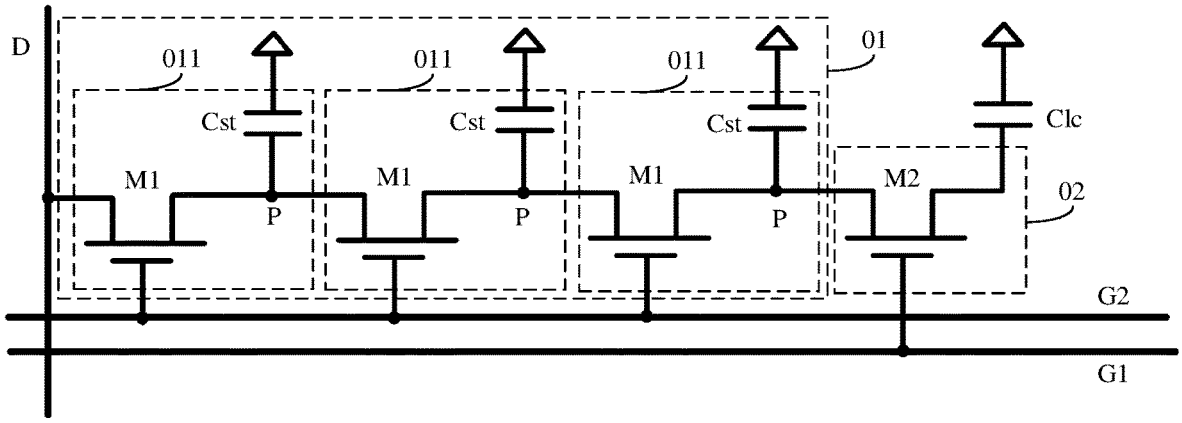
Figures 1, 2:
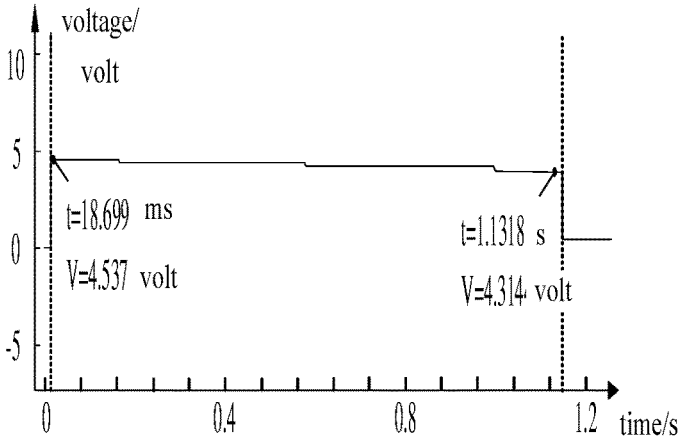
Figure 2:
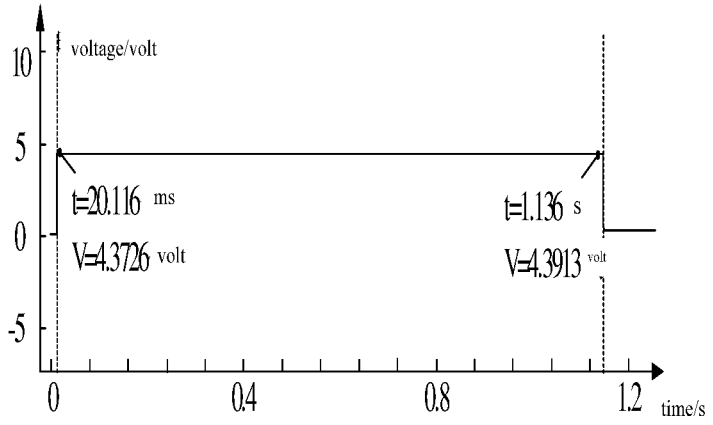
Figures 1, 3:
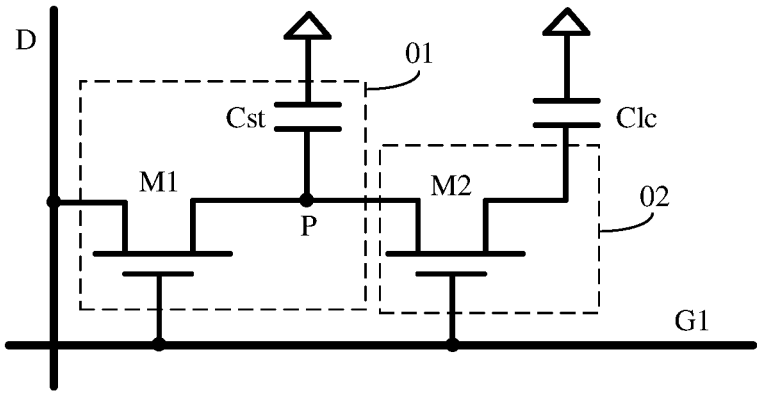
Figures 2, 3:
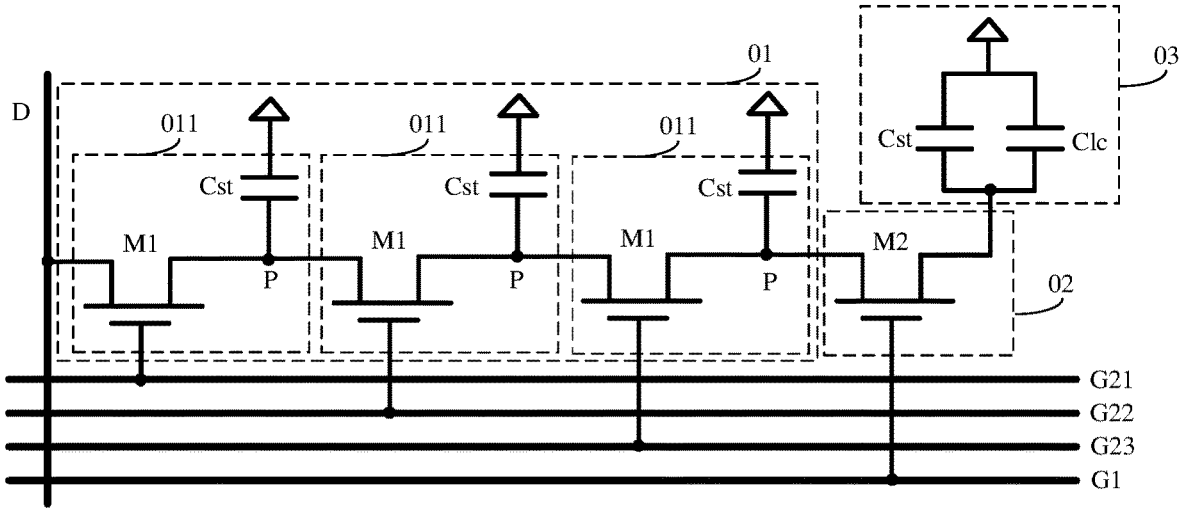

In a second implementable mode, as shown in FIG. 1-3, the first charging sub-circuit 01 may comprise at least two charging sub-sub-circuits 011 connected in series (FIG. 1-3 is the case in which the first charging sub-circuit comprises three charging sub-sub-circuits), wherein each charging sub-sub-circuit 011 may comprise a first transistor M1 and a storage capacitor Cst.

A gate of the first transistor M1 may be connected to the gate line G1 (this connection manner is not shown in FIG. 1-3).

Or, the pixel circuit may further comprise a control line G2, the gate of the first transistor M1 is connected to the control line G2.

A second electrode of the first transistor M1 is connected to one terminal of the storage capacitor Cst, and the other terminal of the storage capacitor Cst is connected to a common electrode.

Among the plurality of charging sub-sub-circuits 011 connected in series, in every two adjacent charging sub-sub-circuits, a second electrode of the first thin film transistor M1 in the charging sub-circuit 011 close to the data line D is connected to a first electrode of the first thin film transistor M1 in the charging sub-sub-circuit 011 away from the data line D. And a first electrode of the first transistor M1 in a first charging sub-sub-circuit is connected to the data line D, and a second electrode of the first transistor M1 in a second charging sub-sub-circuit is connected to the charging node P. The first charging sub-sub-circuit and the second charging sub-sub-circuit are charging sub-sub-circuits at two ends of the at least two charging sub-sub-circuits connected in series.

Optionally, referring to FIGS. 1-2 and 1-3, the second charging sub-circuit 02 may comprise a second transistor M2. A gate of the second transistor M2 is connected to the gate line G1, a first electrode of the second transistor M2 is connected to the charging node P, and a second electrode of the second transistor M2 is connected to the liquid crystal capacitor Clc in the display sub-circuit.

In the pixel circuit shown in FIG. 1-2, the first transistor M1 and the second transistor M2 are spaced between the liquid crystal capacitor Clc and the data line D. After charging of the liquid crystal capacitor Clc is completed, the second electrode of the second transistor M2 is kept at a high potential, meanwhile the second electrode of the first transistor M1 is also kept at a high potential, and a voltage difference between the two is relatively small, this relatively small voltage difference forms an obstacle when outputting the leakage current, so that the leakage current outputted to the data line D is reduced when the second transistor M2 is turned off, thereby a magnitude of voltage decrease on one electrode (i.e., the pixel electrode) of the liquid crystal capacitor Clc connected to the second charging sub-circuit 02 is reduced, accordingly, a magnitude of capacitance decrease of the liquid crystal capacitor Clc is reduced, the effect on deflection of liquid crystal molecules is reduced. In the case where the first charging sub-circuit 01 comprises at least two charging sub-sub-circuits 011 connected in series, as for the principle of that the pixel circuit causes the leakage current outputted to the data line D to reduce when the second transistor M2 is turned off, reference may be made to this principle, no more details are repeated here.

Referring to FIG. 2-1, which shows a simulation diagram of a voltage holding situation of the voltage at the second electrode of the first transistor within one frame of time (e.g., 1 second) after the pixel circuit shown in FIG. 1-2 charges the liquid crystal capacitor Clc, referring to FIG. 2-2, which shows a simulation diagram of a voltage holding situation of the voltage at the second electrode of the second transistor within one frame of time after the pixel circuit shown in FIG. 1-2 charges the liquid crystal capacitor Clc. According to FIGS. 2-1 and 2-2, it can be known that, the voltage at the second electrode of the first transistor only slightly decreases within one frame of time after completion of the charging, and the voltage at the second electrode of the second transistor barely decreases, because the second electrode of the second transistor is connected to the pixel electrode, the voltage at the second electrode of the second transistor is the voltage of the pixel electrode, that is, when the first charging sub-circuit comprises only the first transistor, it can reduce a magnitude of decrease of the voltage at the pixel electrode, even the voltage at the pixel electrode does not decrease at all, thereby ensuring the image display effect of the display. Moreover, circuit of the pixel circuit in this case is relatively simple, and it is easy to implement control of the circuit.

Optionally, as shown in FIG. 3-1, in the pixel circuit described above, the gate of the first transistor and the gate of the second transistor may be both connected to the gate line G1.

Or, when the gate of the first transistor is connected to the control line and the gate of the second transistor is connected to the gate line, the control line and the gate line may also be electrically connected to each other. When the two are electrically connected to each other, all of the transistors in each pixel circuit are turned on at the same time, and the data line can simultaneously start charging a plurality of transistors.

Or, the pixel circuit may comprise a plurality of control lines, the gate of the first transistor in each charging sub-sub-circuit may be respectively connected to a different control line, please refer to FIG. 3-2 for a schematic diagram of its connection. As shown in FIG. 3-2, the pixel circuit comprises a control line G21, a control line G22 and a control line G23. The gate of the first transistor M1 of the three charging sub-sub-circuits 011 connected in series is sequentially connected to the control line G21, the control line G22 and the control line G23. In this case, the time at which the plurality of transistors in the pixel circuit are turned on is different, and the data line can charge the at least two transistors connected in series in accordance with the time at which the transistors are turned on.

In practical applications, the second electrode of the second transistor may be also connected to a storage capacitor Cst, and the storage capacitor Cst is connected in parallel with the liquid crystal capacitor Clc, as for its specific connection manner, please refer to the dotted-line box 03 in FIG. 3-2.

Further, a capacitance value of the storage capacitor in the pixel circuit is greater than a capacitance value of the liquid crystal capacitor. And the larger the capacitance difference between the storage capacitor and the liquid crystal capacitor is, the smaller the voltage difference between the second electrode of the second transistor and the second electrode of the first transistor is, and the leakage current thereof when the second transistor is turned off can be small enough or even there is no leakage current at all, so that the degree by which the voltage of the pixel electrode decreases is small enough or said voltage does not decrease at all. Therefore, the better the holding capacity of the voltage on pixel electrode is, the smaller the reduction magnitude of the capacitance of the liquid crystal capacitor is, or even there is no reduction at all, in this way, normal deflection of the liquid crystal molecules can be better ensured.

Figure 4:
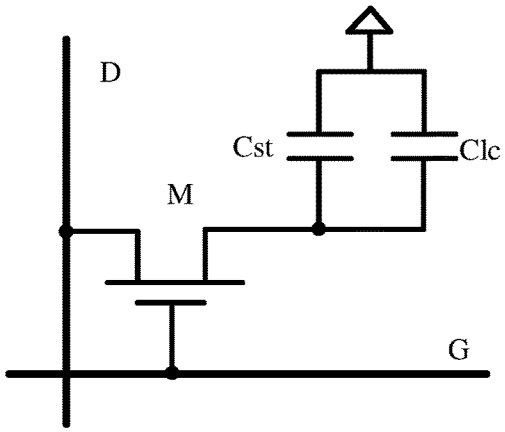
FIG. 4 is a schematic diagram of a pixel circuit in the related art.

Referring to FIG. 4 for the schematic diagram of a pixel circuit in the related art, the pixel circuit includes only one transistor M. The gate of the transistor M is connected to the gate line G, the first electrode of the transistor M is connected to the data line D, the second electrode of the transistor M is respectively connected to the liquid crystal capacitor Clc and the storage capacitor Cst. After the transistor M is turned off, there is a large voltage difference between two electrodes of the transistor (this voltage difference is the difference between the potential of the signal loaded on the data line and the potential at the second electrode of the transistor, for example, the voltage difference may be 5V), the second electrode of the transistor can easily output a leakage current to the data line, under its influence, the voltage at the pixel electrode of the liquid crystal capacitor connected to the second electrode of the transistor is reduced, resulting in poor voltage holding capability of the pixel electrode, so that deflection of liquid crystal molecules is greatly affected.

Relative to the related art, in the pixel circuit provided by the embodiment of the present disclosure, the first charging sub-circuit and the second charging sub-circuit are spaced between the display sub-circuit and the data line, after the first charging sub-circuit outputs a data signal to the charging node and the second charging sub-circuit outputs the data signal from the charging node to the display sub-circuit, the first charging sub-circuit can store the data signal, so that the charging node can be kept at a high voltage, and a voltage difference between two terminals of the second charging sub-circuit is relatively small, this relatively small voltage difference causes a leakage current outputted to the data line to decrease, thereby a magnitude of voltage decrease on one electrode of the liquid crystal capacitor connected to the second charging sub-circuit is reduced, accordingly, a magnitude of capacitance decrease of the liquid crystal capacitor is reduced, thus effectively reducing the influence caused by the leakage current on deflection of liquid crystal molecules, and ensuring the image display effect of the display, thereby solving the technical problem that the pixel electrode cannot hold its voltage at a high potential within one second or even for a longer time as existing in the related art.

Figure 5:
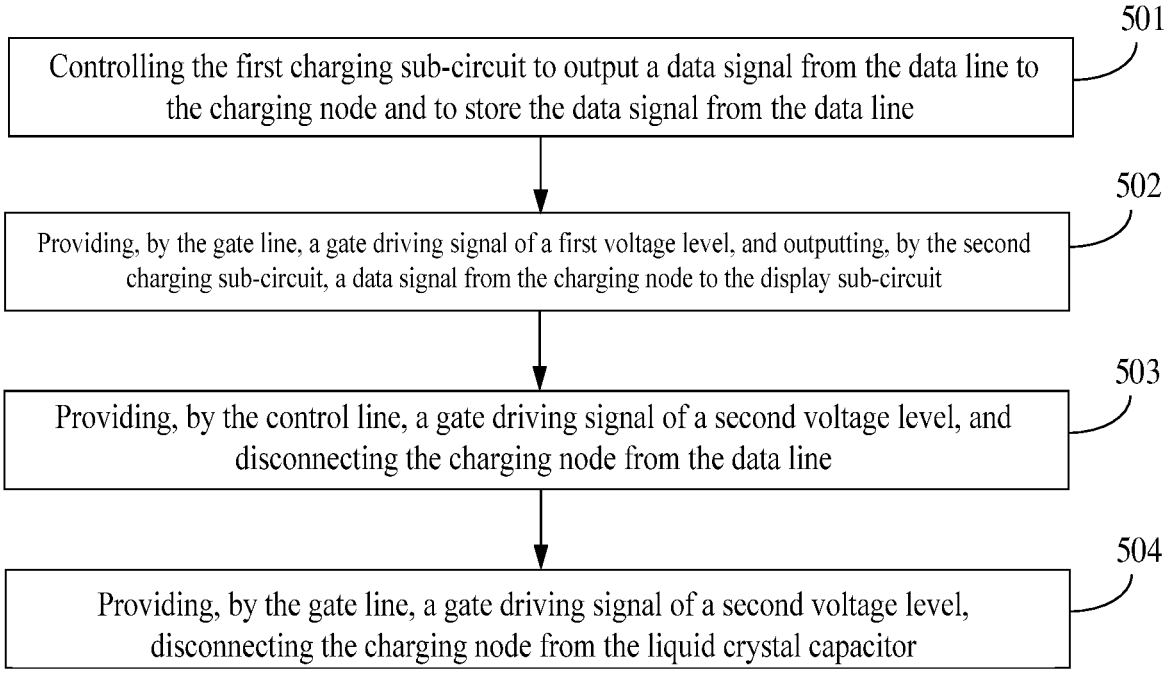
FIG. 5 is a driving method of a pixel circuit according to an embodiment of the present disclosure.

FIG. 5 is a driving method of a pixel circuit according to an embodiment of the present disclosure, the driving method may be applied to the pixel circuit shown in any one of FIG. 1-2, 1-3, 3-1, or 3-2, the pixel circuit may comprise a gate line G1, a data line D, a first charging sub-circuit 01, a second charging sub-circuit 02 and a display sub-circuit 03, the second charging sub-circuit 02 is respectively connected to the charging node P, the gate line G1 and the display sub-circuit 03, as shown in FIG. 5, the driving method of the pixel circuit may comprise:

Step 501, controlling the first charging sub-circuit to output a data signal from the data line to the charging node and to store the data signal from the data line;

Step 502, providing, by the gate line, a gate driving signal of a first voltage level, and outputting, by the second charging sub-circuit, a data signal from the charging node to the display sub-circuit;

Step 503, providing, by the control line, a gate driving signal of a second voltage level, and disconnecting the charging node from the data line; and Step 504, providing, by the gate line, a gate driving signal of a second voltage level, disconnecting the charging node from the liquid crystal capacitor.

In summary, in the driving method of the pixel circuit provided by the embodiment of the present disclosure, by means of controlling the first charging sub-circuit to output a data signal from the data line to the charging node and to store the data signal from the data line, providing, by the gate line, a gate driving signal of a first voltage level, and outputting, by the second charging sub-circuit, a data signal from the charging node to the display sub-circuit, the first charging sub-circuit and the second charging sub-circuit are spaced between the display sub-circuit and the data line, after the first charging sub-circuit outputs a data signal to the charging node and the second charging sub-circuit outputs the data signal from the charging node to the display sub-circuit, the first charging sub-circuit can store the data signal, so that the charging node can be kept at a high voltage, and a voltage difference between two terminals of the second charging sub-circuit is relatively small, this relatively small voltage difference causes a leakage current outputted to the data line to decrease, therefore, a magnitude of voltage drop of one terminal of the liquid crystal capacitor connected to the second charging sub-circuit is effectively reduced, accordingly, a magnitude of capacitance decrease of the liquid crystal capacitor is reduced, thus effectively reducing the influence caused by the leakage current on deflection of liquid crystal molecules, and ensuring the image display effect of the display.

The display sub-circuit 03 may comprise a liquid crystal capacitor, outputting the data signal from the charging node to the display sub-circuit is a process of charging the liquid crystal capacitor.

Optionally, as shown in FIGS. 1-2, 1-3, 3-1 and 3-2, the first charging sub-circuit 01 may comprise a first transistor M1 and a storage capacitor Cst; a gate of the first transistor M1 is connected to the gate line G1 or the control line G2; the second charging sub-circuit 02 may comprise a second transistor M2, a gate of the second transistor M2 is connected to the gate line G1, and a second electrode of the first transistor M1 is connected to a first electrode of the second transistor M2.

When the gate of the first transistor M1 is connected to the gate line G1 or the control line G2 and the gate of the second transistor M2 is connected to the gate line G1, conducting states of the first transistor M1 and the second transistor M2 are different, accordingly, the process of that the data line D charges the liquid crystal capacitor Clc through the first charging sub-circuit 01 and the second charging sub-circuit 02 is also different, in both cases, the driving method of the pixel circuit may be divided into the following three implementable modes.

First implementable mode: when the gate of the first transistor M1 is connected to the control line G2 and the gate of the second transistor M2 is connected to the gate line G1, conducting states of the first transistor M1 and the second transistor M2, as well as the process of that the data line D charges the liquid crystal capacitor Clc through the first charging sub-circuit 01 and the second charging sub-circuit 02 may include, for example, two periods:

In a first charging period t1, when the control line G2 provides the gate driving signal of a first voltage level, the first transistor M1 is turned on under action of the gate driving signal, and the data line D charges the storage capacitor Cst through the first transistor M1.

In a second charging period t2, when the gate line G1 provides the gate driving signal of a first voltage level, the second transistor M2 is turned on under action of the gate driving signal, and the storage capacitor Cst charges the liquid crystal capacitor Clc through the second transistor M2.

Optionally, when time lengths of the two charging periods are equal, the time of the two charging periods may completely overlap, partially overlap, or not overlap at all. In this case, please refer to FIGS. 6-1, 6-2 and 6-3 respectively for the waveform diagram of the gate driving signal loaded on the control line G2 connected to the gate of the first transistor M1 and the gate line G1 connected to the gate of the second transistor M2. Alternatively, time lengths of the two charging periods may also be unequal, in this case, the time of the two periods may partially overlap or not overlap at all.

In the embodiment of the present disclosure, the whole charging process is described with the time of the two charging periods does not overlap at all as an example. When the time of the two periods completely overlaps or partially overlaps, its charging process may consult the process when the time of the two periods does not overlap at all.

Figures 1, 6:
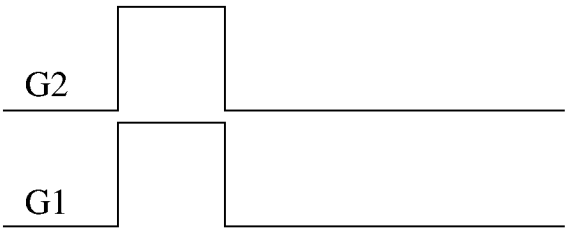
Figures 2, 6:
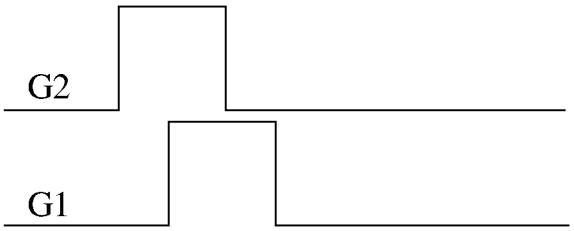
Figures 3, 6:
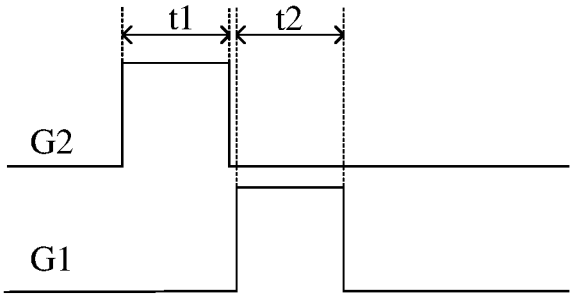
Figures 4, 6:
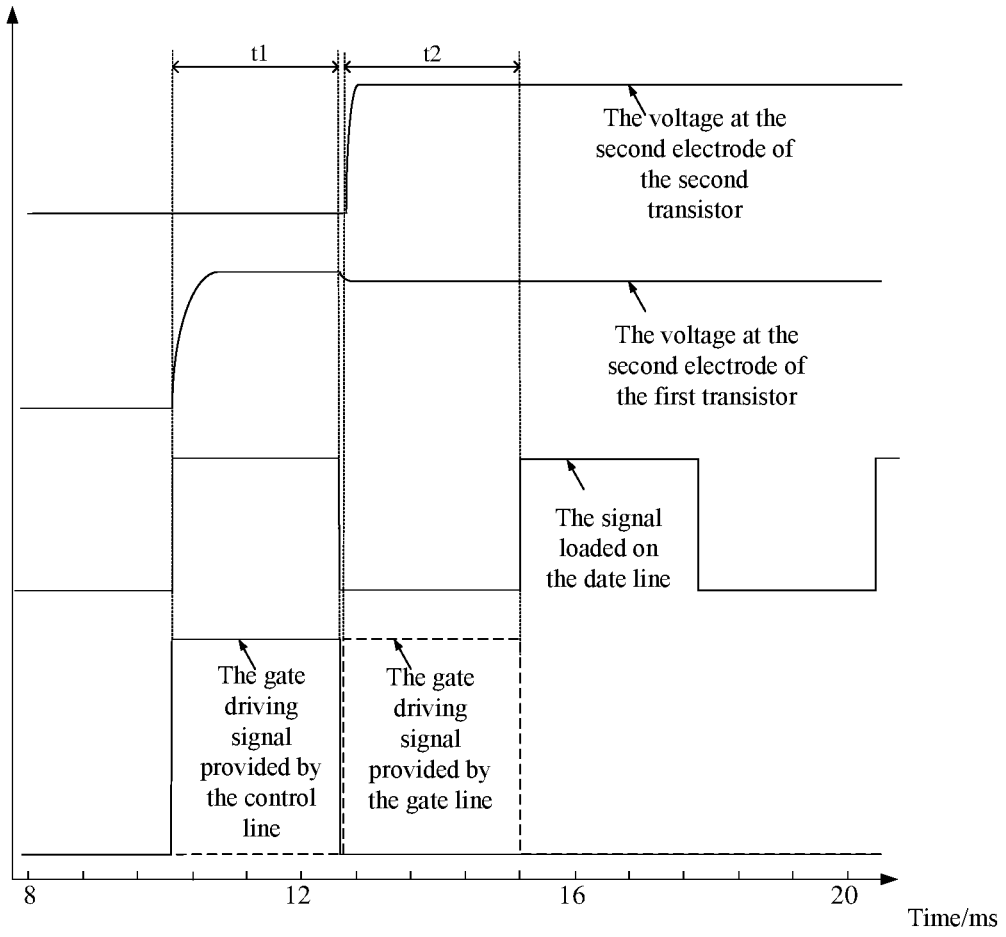

As for the pixel circuit shown in FIG. 1-2, when time of the two periods does not overlap at all, referring to FIG. 6-3, its charging process includes a first charging period t1 and a second charging period t2.

In the first charging period t1, the control line G2 provides the gate driving signal of a first voltage level (e.g., 10 volts), the first transistor M1 is turned on under action of the gate driving signal, and the data line D charges the second electrode of the first transistor M1 through the first transistor M1, that is, charging the storage capacitor Cst, so that the voltage of the second electrode of the first transistor M1 (i.e., the electrode connected to the storage capacitor Cst) has been charged to the first high potential (e.g., 10 volts).

In the second charging period t2, when the gate line G1 provides the gate driving signal of a first voltage level, the second transistor M2 is turned on under action of the gate driving signal, and the second electrode of the first transistor M1 (that is, the storage capacitor Cst) charges the liquid crystal capacitor Clc through the second transistor M2 (i.e., charging the pixel electrode), so as to charge the second electrode of the second transistor M2 and the pixel electrode to the second high potential.

Moreover, as can be seen from FIG. 6-3, in the second charging period t2, the control line G2 provides the gate driving signal of a second voltage level (e.g., 0 volts), at this time, the first transistor M1 is turned off, the charging node P is disconnected from the data line D.

After the second charging period t2, the gate driving signal provided by the gate line G1 jumps to a second voltage level, the second transistor M2 is turned off, and the charging node P is disconnected from the liquid crystal capacitor Clc.

Herein, please refer to FIG. 6-4 for voltage waveforms of the gate driving signal provided by the control line G2, the gate driving signal provided by the gate line G1, the signal loaded on the data line D, and the second electrode of the first transistor M1 and the second electrode of the second transistor M2 in the first charging period t1 and the second charging period t2.

It should be noted that, the magnitude of the first high potential is mainly determined by the potential of the data line D, the magnitude of the second high potential is determined by the magnitude of the first high potential, the capacitance value of the storage capacitor Cst and the capacitance value of the liquid crystal capacitor Clc all together. Moreover, the larger the capacitance difference between the storage capacitor Cst and the liquid crystal capacitor Clc is, the smaller the voltage difference between the second electrode of the second transistor M2 and the second electrode of the first transistor M1 is, thus in practical applications, the capacitance value of the storage capacitor Cst may be set as much larger than the capacitance value of the liquid crystal capacitor Clc, for example, the capacitance value of the storage capacitor Clc may be set as 10 times of the capacitance value of the liquid crystal capacitor Cst.

In practical applications, the second high potential is obtained after a certain voltage drop occurs on the basis of the first high potential, and the potential of the pixel electrode is obtained after a certain voltage drop occurs on the basis of the second high potential, under this premise, in order to reduce the voltage difference between the second high potential and the first high potential and the voltage difference between the potential of the pixel electrode and the second high potential as much as possible, it is possible to adopt the manner of increasing the magnitude of the voltage on the common electrode so as to compensate for said voltage drop, so that the second high potential is closer to the first high potential, and the potential of the pixel electrode is closer to the second high potential or even equal to the first high potential.

Second implementable mode: when the gate of the first transistor M1 and the gate of the second transistor M2 are both connected to the gate line G1, conducting states of the first transistor M1 and the second transistor M2, and the process of that the data line D charges the liquid crystal capacitor Clc through the first charging sub-circuit 01 and the second charging sub-circuit 02 may, for example, be the following:

When the gate line G1 to which the first transistor M1 and the second transistor M2 are connected provides the gate driving signal of a first voltage level, the first transistor M1 and the second transistor M2 are turned on under action of the gate driving signal, and in the process of turning on the first transistor M1 and the second transistor M2, the data line D charges the liquid crystal capacitor Clc through the first transistor M1 and the second transistor M2.

Third implementable mode: when the gate of the first transistor M1 is connected to the control line G2, the gate of the second transistor M2 is connected to the gate line G1, and the control line G2 and the gate line G1 are electrically connected to each other, conducting states of the first transistor M1 and the second transistor M2, and the process of that the data line D charges the liquid crystal capacitor Clc through the first charging sub-circuit 01 and the second charging sub-circuit 02 may, for example, be the following:

When the gate line G1 (or the control line G2) provides the gate driving signal of a first voltage level, the first transistor M1 and the second transistor M2 are turned on under action of the gate driving signal, and in the process in which the first transistor M1 and the second transistor M2 are turned on, the data line D charges the liquid crystal capacitor Clc through the first transistor M1 and the second transistor M2.

Optionally, the first voltage level is a high voltage level with respect to the second voltage level, for example, the first level is 10 volts, and the second level is 0 volts.

It should be noted that, in the case where the first charging sub-circuit 01 includes at least two charging sub-circuits 011 connected in series, and the gate of the first transistor M1 in each charging sub-sub-circuit 011 of at least two charging sub-circuits 011 connected in series is respectively connected to a different control line, please refer to the driving method described above for the driving method of the pixel circuit, the embodiment of the present disclosure makes no repetition.

In summary, in the driving method of the pixel circuit provided by the embodiment of the present disclosure, by means of controlling the first charging sub-circuit to output a data signal from the data line to the charging node and to store the data signal from the data line, providing, by the gate line, a gate driving signal of a first voltage level, and outputting, by the second charging sub-circuit, a data signal from the charging node to the display sub-circuit, the first charging sub-circuit and the second charging sub-circuit are spaced between the display sub-circuit and the data line, after the first charging sub-circuit outputs a data signal to the charging node and the second charging sub-circuit outputs the data signal from the charging node to the display sub-circuit, the first charging sub-circuit can store the data signal, so that the charging node can be kept at a high voltage, and a voltage difference between two terminals of the second charging sub-circuit is relatively small, this relatively small voltage difference causes a leakage current outputted to the data line to decrease, thereby a magnitude of voltage decrease on one electrode of the liquid crystal capacitor connected to the second charging sub-circuit is reduced, accordingly, a magnitude of capacitance decrease of the liquid crystal capacitor is reduced, thus effectively reducing the influence caused by the leakage current on deflection of liquid crystal molecules, and ensuring the image display effect of the display, thereby solving the technical problem that the pixel electrode cannot hold its voltage at a high potential within one second or even for a longer time as existing in the related art.

Figure 7:
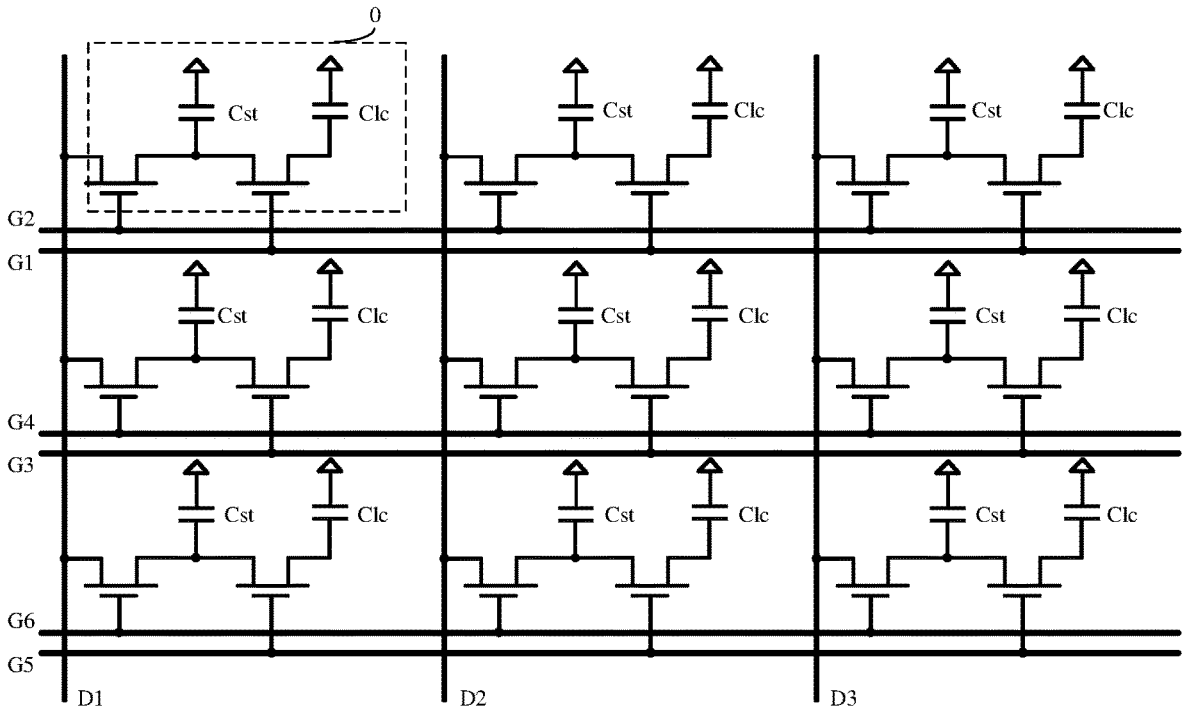
FIG. 7 is a schematic diagram of structure of a display substrate according to an embodiment of the present disclosure.

FIG. 7 is a schematic diagram of structure of a display substrate according to an embodiment of the present disclosure, as shown in FIG. 7, the display substrate may comprise a plurality of gate lines (the plurality of gate lines respectively are G1, G3 and G5 in the drawings), a plurality of data lines (the plurality of data lines respectively are D1, D2 and D3 in the drawings) and a plurality of pixel units enclosed by said gate lines and said data lines that are intersected, the plurality of pixel units being arranged in an array, wherein each pixel unit includes a pixel circuit 0 (as denoted by the dotted-line box in FIG. 7), and the pixel circuit may be the pixel circuit shown by any one of FIGS. 1-2, 1-3, 3-1 and 3-2.

In an implementable mode, the display substrate may further comprise a plurality of control lines (the plurality of control lines respectively are G2, G4 and G6 in the drawings), the first charging sub-circuit in the pixel circuit is connected to the plurality of control lines, and is located in two pixel units that are in the same column and adjacent, a gate line connected to the second charging sub-circuit of the pixel circuit in a first pixel unit and a control line connected to the first charging sub-circuit of the pixel circuit in a second pixel unit are electrically connected to each other (this connection manner is not shown in the drawings), wherein the first pixel unit and the second pixel unit are arranged in accordance with a direction in which the plurality of pixel units are scanned by the plurality of gate lines.

Exemplarily, it is assumed that the plurality of gate lines in FIG. 7 scan the plurality of pixel units in an order from top to bottom, the gate line G1 connected to the second charging sub-circuit of the pixel circuit in the first row of pixel units and the control line G4 connected to the first charging sub-circuit of the pixel circuit in the second row of pixel units may be electrically connected to each other. When the two are electrically connected, the second transistor of the pixel circuit in the first pixel unit and the first transistor of the pixel circuit in the second pixel unit can be simultaneously turned on and charged, which reduces the total charging time of the liquid crystal capacitor on the display substrate.

In another implementation mode, in the two pixel units that are located in the same column and adjacent, the second charging sub-circuit of the pixel circuit in the first pixel unit and the first charging sub-circuit of the pixel circuit in the second pixel unit may be each connected to the same one gate line, wherein the first pixel unit and the second pixel unit are arranged in accordance with a direction in which the plurality of pixel units are scanned by the plurality of gate lines.

When the second charging sub-circuit of the pixel circuit in the first pixel unit and the first charging sub-circuit of the pixel circuit in the second pixel unit are both connected to the same gate line, relative to the case where the gate line to which the second charging sub-circuit of the pixel circuit in the first pixel unit and the control line connected to the first charging sub-circuit of the pixel circuit in the second pixel unit are different gate lines, an aperture ratio of the display substrate is increased.

Figures 1, 8:
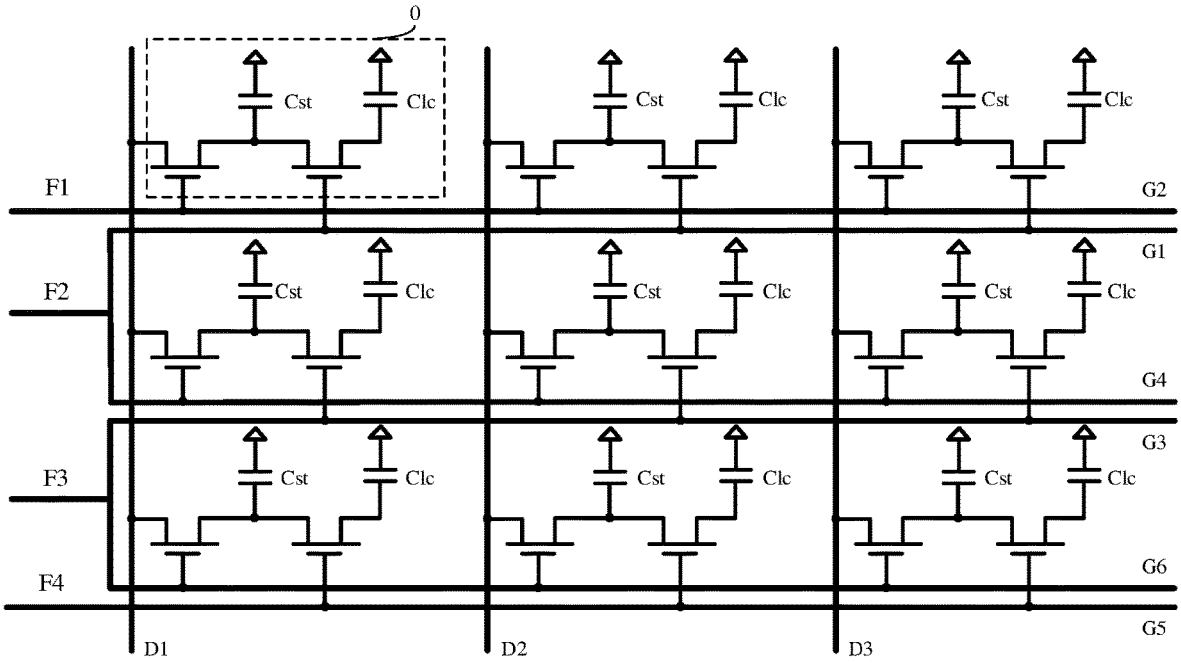
Figures 2, 8:
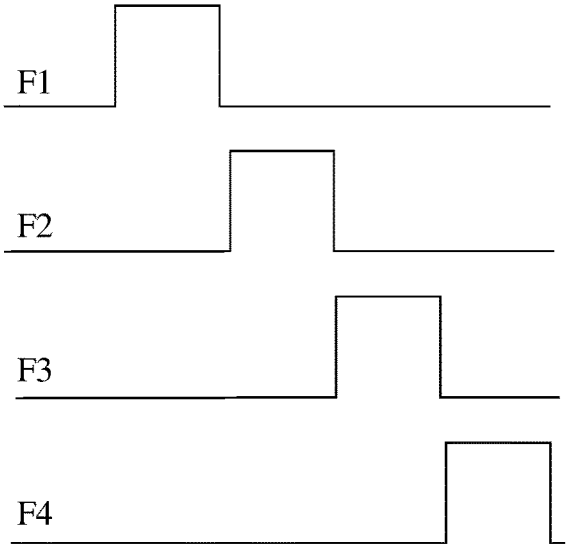
Figures 3, 8:
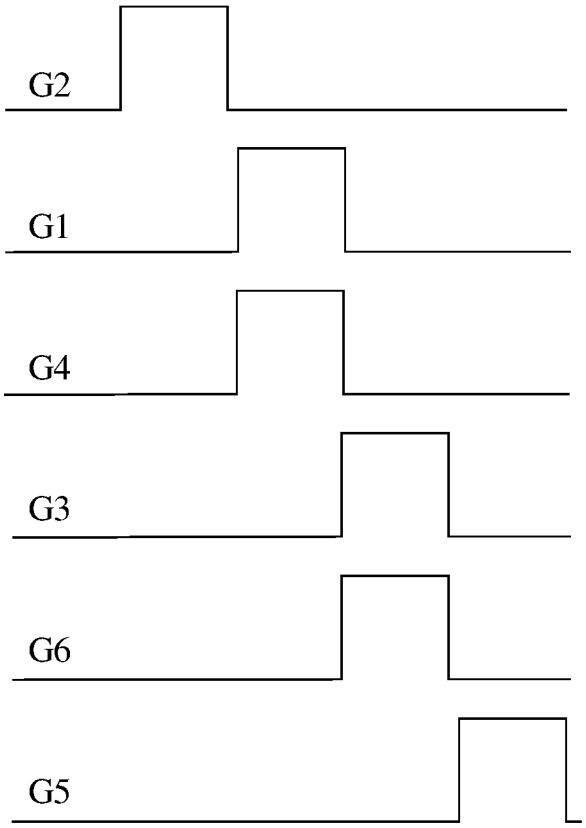

In still another implementation mode, as shown in FIG. 8-1, in two pixel units that are located in the same column and adjacent, the gate line connected to the second charging sub-circuit of the pixel circuit in the first pixel unit and the control line connected to the first charging sub-circuit of the pixel circuit in the second pixel unit may be connected to the same one gate driving signal output terminal, wherein the first pixel unit and the second pixel unit are arranged in accordance with a direction in which the plurality of pixel units are scanned by the plurality of gate lines.

For example, FIG. 8-1 is a schematic diagram of connection between a plurality of gate lines (G1, G3 and G5), a plurality of control lines (G2, G4 and G6) and a plurality of gate driving signal output terminals (F1, F2, F3 and F4), as shown in FIG. 8-1, the gate line G1 connected to the second charging sub-circuit of the pixel circuit in the first row of pixel units and the control line G4 connected to the first charging sub-circuit of the pixel circuit in the second row of pixel units may be connected to the same gate driving signal terminal F2.

For the structure shown in FIG. 8-1, signal waveform of outputs at each gate driving signal output terminal may be as shown in FIG. 8-2, that is, each gate driving signal output terminal can sequentially output the gate driving signal of a first voltage level. Correspondingly, waveform of the gate driving signal loaded on the respective gate line in the display substrate may be as shown in FIG. 8-3. As can be seen from FIG. 8-3, the gate driving signals loaded on the gate line and the control line that are connected to the same gate driving signal output terminal are the same.

When the gate line connected to the second charging sub-circuit of the pixel circuit in the first pixel unit and the control line connected to the first charging sub-circuit of the pixel circuit in the second pixel unit are connected to the same one gate driving signal output terminal, the second transistor in the second charging sub-circuit of the pixel circuit in the first pixel unit and the first transistor in the first charging sub-circuit of the pixel circuit in the second pixel unit can be simultaneously charged, which reduces the total charging time of the liquid crystal capacitor on the display substrate, without increasing the number of gate driving signal output terminals, this relatively reduces production cost of the display substrate.

In summary, the display substrate provided by the embodiment of the present disclosure comprises a plurality of pixel units each of which includes a pixel circuit, the first charging sub-circuit and the second charging sub-circuit are spaced between the display sub-circuit and the data line in each pixel circuit, after the first charging sub-circuit outputs a data signal to the charging node and the second charging sub-circuit outputs the data signal from the charging node to the display sub-circuit, the first charging sub-circuit can store the data signal, so that the charging node can be kept at a high voltage, and a voltage difference between two terminals of the second charging sub-circuit is relatively small, this relatively small voltage difference causes a leakage current outputted to the data line to decrease, thereby a magnitude of voltage decrease on one electrode of the liquid crystal capacitor connected to the second charging sub-circuit is reduced, accordingly, a magnitude of capacitance decrease of the liquid crystal capacitor is reduced, thus effectively reducing the influence caused by the leakage current on deflection of liquid crystal molecules, and ensuring the image display effect of the display, thereby solving the technical problem that the pixel electrode cannot hold its voltage at a high potential within one second or even for a longer time as existing in the related art.

The embodiment of the present disclosure further provides a display device, which may comprise the display substrate shown in FIG. 7 or 8-1. The display device may be any product or component having a display function such as a liquid crystal panel, an electronic paper, a mobile phone, a tablet computer, a television, a display, a notebook computer, a digital photo frame, a navigator, and the like.

As will be appreciated by those of ordinary skill in the art, all or parts of the steps in the above embodiments may be implemented by hardware, or by a program that instructs relevant hardware, the program may be stored in a computer readable storage medium, the aforesaid storage medium may be a read-only memory, a magnetic disc, an optical disk, or the like.

The foregoing is only preferred embodiments of the present disclosure, and is not intended to limit the present disclosure, any modification, equivalent replacement, improvement and so on made within the spirit and principle of the present disclosure should be included in the protection scope of the present disclosure.

What is claimed is:

1. A pixel circuit, comprising:

a gate line, a data line, a first charging sub-circuit, a second charging sub-circuit and a display sub-circuit;

the first charging sub-circuit is configured to be controllable to output a data signal from the data line to a charging node and to store the data signal from the data line, wherein the first charging sub-circuit comprises a first transistor and a storage capacitor, a gate of the first transistor is connected to a control line; or the first charging sub-circuit comprises at least two charging sub-sub-circuits connected in series and each charging sub-sub-circuit comprises the first transistor and the storage capacitor, a gate of the first transistor in each charging sub-sub-circuit is respectively connected to a plurality of control lines; and the second charging sub-circuit is respectively connected to the charging node, the gate line and the display sub-circuit, and is configured to be controllable to output a data signal from the charging node to the display sub-circuit, wherein the second charging sub-circuit comprises a second transistor, a gate of the second transistor is connected to the gate line; and the display sub-circuit comprises a liquid crystal capacitor, wherein a process of charging the liquid crystal capacitor by the first charging sub-circuit and the second charging sub-circuit comprises two periods:

in a first charging period, when the control line provides a gate driving signal of a first voltage level, the first transistor is turned on under action of the gate driving signal, and the data line charges the storage capacitor through the first transistor;

in a second charging period, when the gate line provides the gate driving signal of the first voltage level, the second transistor is turned on under action of the gate driving signal, and the storage capacitor charges the liquid crystal capacitor through the second transistor, wherein when the control line provides a gate driving signal of a second voltage level, the first transistor is turned off, the charging node is disconnected from the data line, wherein after the second charging period, when the gate driving signal provided by the gate line jumps to the second voltage level, the second transistor is turned off, and the charging node is disconnected from the liquid crystal capacitor.

2. The pixel circuit of claim 1, wherein in a case of the first charging sub-circuit comprises the first transistor and the storage capacitor, a first electrode of the first transistor is connected to the data line, and a second electrode of the first transistor is connected to the charging node;

one terminal of the storage capacitor is connected to the charging node, and the other terminal of the storage capacitor is connected to a common electrode.

3. The pixel circuit of claim 1, wherein in a case of the first charging sub-circuit comprises at least two charging sub-sub-circuits connected in series, each charging sub-sub-circuit comprises the first transistor and the storage capacitor, a second electrode of the first transistor is connected to one terminal of the storage capacitor, and the other terminal of the storage capacitor is connected to a common electrode;

among the plurality of charging sub-sub-circuits connected in series, a first electrode of the first transistor in a first charging sub-sub-circuit is connected to the data line, and a second electrode of the first transistor in a second charging sub-sub-circuit is connected to the charging node;

the first charging sub-sub-circuit and the second charging sub-sub-circuit are charging sub-sub-circuits at two ends of the at least two charging sub-sub-circuits connected in series.

4. The pixel circuit of claim 1, wherein a first electrode of the second transistor is connected to the charging node, and a second electrode of the second transistor is connected to the display sub-circuit.

5. The pixel circuit of claim 2, wherein the control line and the gate line are electrically connected to each other.

6. The pixel circuit of claim 2, wherein a capacitance value of the storage capacitor in the pixel circuit is greater than a capacitance value of the liquid crystal capacitor.

7. A driving method for a pixel circuit, wherein the pixel circuit comprises a gate line, a data line, a first charging sub-circuit, a second charging sub-circuit and a display sub-circuit, wherein the first charging sub-circuit comprises a first transistor and a storage capacitor, a gate of the first transistor is connected to a control line; or the first charging sub-circuit comprises at least two charging sub-sub-circuits connected in series and each charging sub-sub-circuit comprises the first transistor and the storage capacitor, a gate of the first transistor in each charging sub-sub-circuit is respectively connected to a plurality of control lines;

the second charging sub-circuit is respectively connected to the charging node, the gate line and the display sub-circuit, and the second charging sub-circuit comprises a second transistor, a gate of the second transistor is connected to the gate line, and the display sub-circuit comprises a liquid crystal capacitor, wherein the method comprises:

providing, by the control line, a gate driving signal of a first voltage level, turning on the first transistor, and charging, by the data line, the storage capacitor through the first transistor;

providing, by the gate line, a gate driving signal of a first voltage level, turning on the second transistor, and charging, by the storage capacitor, the liquid crystal capacitor through the second transistor;

providing, by the control line, a gate driving signal of a second voltage level, and disconnecting the charging node from the data line; and providing, by the gate line, a gate driving signal of a second voltage level, and disconnecting the charging node from the liquid crystal capacitor.

8. A display substrate, comprising a plurality of gate lines, a plurality of data lines and a plurality of pixel units enclosed by said gate lines and said data lines that are intersected, the plurality of pixel units being arranged in an array, wherein each pixel unit includes a pixel circuit, and the pixel circuit is the pixel circuit according to claim 1.

9. The display substrate of claim 8, wherein the display substrate further comprises a plurality of control lines, the first charging sub-circuit in the pixel circuit is connected to the control lines, and is located in two pixel units that are in the same column and adjacent, a gate line connected to the second charging sub-circuit in a first pixel unit and a control line connected to the first charging sub-circuit in a second pixel unit are electrically connected to each other, wherein the first pixel unit and the second pixel unit are arranged in accordance with a direction of scanning the plurality of pixel units as performed by the plurality of gate lines.

10. A display device, comprising the display substrate of claim 8.

11. A display device, comprising the display substrate of claim 9.

* * * * *